US008422897B2

(12) United States Patent
Suzuki et al.

(10) Patent No.: US 8,422,897 B2
(45) Date of Patent: Apr. 16, 2013

(54) IMAGE FORMING APPARATUS

(75) Inventors: Hirokatsu Suzuki, Kanagawa (JP); Kazuhisa Sudo, Kanagawa (JP); Masanori Kawasumi, Kanagawa (JP); Shunichi Hashimoto, Kanagawa (JP); Mugijirou Uno, Kanagawa (JP); Akira Shinshi, Tokyo (JP); Masaharu Furuya, Kanagawa (JP); Masahiko Satoh, Tokyo (JP); Hirohmi Tamura, Kanagawa (JP); Kazuya Saitoh, Kanagawa (JP); Tomoko Takahashi, Kanagawa (JP); Takuya Suganuma, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 321 days.

(21) Appl. No.: 12/870,149

(22) Filed: Aug. 27, 2010

(65) Prior Publication Data

US 2011/0058832 A1 Mar. 10, 2011

(30) Foreign Application Priority Data

Sep. 10, 2009 (JP) ..... 2009-209679

(51) Int. Cl.
*G03G 15/00* (2006.01)

(52) U.S. Cl.
USPC ..... 399/49; 399/72; 399/300; 399/302; 399/303; 399/308

(58) Field of Classification Search ..... 399/49, 399/72, 300, 302, 303, 308
See application file for complete search history.

(56) References Cited

U.S. PATENT DOCUMENTS

| | | | | |
|---|---|---|---|---|
| 7,149,465 | B2 | 12/2006 | Amemiya et al. | |
| 7,228,099 | B2 | 6/2007 | Shintani et al. | |
| 7,292,816 | B2 | 11/2007 | Ojimi et al. | |
| 7,313,347 | B2 | 12/2007 | Shintani et al. | |
| 7,373,101 | B2 | 5/2008 | Hozumi et al. | |
| 7,493,075 | B2 | 2/2009 | Shintani et al. | |
| 7,672,635 | B2 | 3/2010 | Hozumi et al. | |
| 2005/0164108 | A1 | 7/2005 | Murakami et al. | |
| 2007/0014596 | A1 | 1/2007 | Sohmiya et al. | 347/171 |
| 2007/0036595 | A1 | 2/2007 | Amemiya et al. | |
| 2007/0116483 | A1 * | 5/2007 | Kobayashi et al. | 399/49 |
| 2007/0183824 | A1 | 8/2007 | Suda et al. | |
| 2007/0286650 | A1 * | 12/2007 | Shimmura | 399/298 |
| 2008/0226311 | A1 | 9/2008 | Senoh et al. | |
| 2009/0180791 | A1 * | 7/2009 | Matsushita et al. | 399/66 |
| 2009/0311016 | A1 | 12/2009 | Shinshi | |
| 2011/0013950 | A1 | 1/2011 | Furuya et al. | |

FOREIGN PATENT DOCUMENTS

| | | |
|---|---|---|
| JP | 2912238 | 4/1999 |
| JP | 2000-35703 | 2/2000 |
| JP | 3366969 | 11/2002 |
| JP | 2002-357938 | 12/2002 |
| JP | 2002-365995 | 12/2002 |
| JP | 2006-30519 | 2/2006 |
| JP | 2006-201743 | 8/2006 |

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

By using a black-image forming device, an abrasive pattern is formed on a sheet conveying belt so that toner is input to a contact section where a cleaning blade is in contact with the sheet conveying belt. After the toner is input to the contact section where the cleaning blade is in contact with the sheet conveying belt and then the sheet conveying belt makes one or more revolutions, a process control is performed in which Y, M, and C toner patterns and B toner pattern are transferred onto the sheet conveying belt.

9 Claims, 5 Drawing Sheets

IMAGE FORMING APPARATUS

CROSS-REFERENCE TO RELATED APPLICATIONS

The present application claims priority to and incorporates by reference the entire contents of Japanese Patent Application No. 2009-209679 filed in Japan on Sep. 10, 2009.

BACKGROUND OF THE INVENTION

1. Field of the Invention

The present invention relates to image forming apparatuses, such as printers, facsimile machines, and copying machines.

2. Description of the Related Art

Image forming apparatuses are known that include a plurality of first image carriers, an intermediate transfer member, a first image forming device, a second image carrier, and a second image forming device (e.g., Japanese Patent Application Laid-open No. 2006-201743). The first image carriers are a plurality of photosensitive elements that carry thereon either yellow (Y), magenta (M), or cyan (C) toner images. The intermediate transfer member is an intermediate transfer belt that sequentially receives the Y, M, and C toner images from the photosensitive elements. The first image forming device is a color-image forming device that transfers the toner images from the intermediate transfer belt to a recording sheet during secondary transfer. The second image carrier is a photosensitive element that carries thereon a black (B) toner image. The second image forming device is a black-image forming device that transfers the black toner image from the photosensitive element directly to the recording sheet.

The image forming apparatus disclosed in Japanese Patent Application Laid-open No. 2006-201743 includes a belt member that is rotatably supported by a plurality of rollers. The belt member carries the recording sheet thereon to both a direct transfer position and a secondary transfer position. The direct transfer position is the position at which the black toner image is directly transferred onto the recording sheet. The secondary transfer position is the position at which the color toner image is transferred from the intermediate transfer belt onto the recording sheet during the secondary transfer. In the image forming apparatus disclosed in Japanese Patent Application Laid-open No. 2006-201743, when the recording sheet passes through both the direct transfer position and the secondary transfer position by rotation of the belt member, the black image, which is transferred onto the recording sheet at the direct transfer position, and the color image, which is transferred onto the recording sheet at the secondary transfer position, are superimposed upon each other so that a full-color image is formed on the recording sheet. Carrying of the recording sheet by using the belt member suppresses any fluctuation that will occur along the recording-sheet conveying path between the direct transfer position and the secondary transfer position, which enables stable conveyance of the recording sheet between the direct transfer position and the secondary transfer position.

A technology is used in the field of image forming apparatuses that increases the life time of the photosensitive elements by applying a lubricant to the photosensitive elements. Some of the lubricant that has been applied to the respective photosensitive elements for Y, M, and C is transferred to the intermediate transfer belt and is further transferred from the intermediate transfer belt to the belt member. Some of the lubricant that has been applied to the photosensitive element for B is also transferred to the belt member.

The transcription efficiency depends on the relation between the coefficient of friction of a member from which an image is transferred (hereinafter, "image transferring member") and the coefficient of friction of a member that receives the image (hereinafter, "image receiving member"). During the toner-image transfer process, in order to maintain the transcription efficiency at a high level, it is necessary to set the coefficient of friction of the image receiving member higher than the coefficient of friction of the image transferring member. Therefore, in the color-image forming device, the coefficient of friction of the intermediate transfer belt is set higher than the coefficient of friction of the photosensitive elements but lower than the coefficient of friction of the recording sheet. The coefficient of friction of the intermediate transfer belt decreases due to the lubricant transferred from the photosensitive elements. However, because the photosensitive elements are always coated with the lubricant and because the lubricant is transferred from the intermediate transfer belt to the recording sheet and the belt member, the coefficient of friction of the intermediate transfer belt cannot decrease to a value lower than the coefficient of friction of the photosensitive elements. Therefore, for the transfer from the photosensitive elements to the intermediate transfer belt, the transcription efficiency is always at a sufficiently high level. In the black-image forming device, the coefficient of friction of the photosensitive element is set lower than the coefficient of friction of the recording sheet to maintain the transcription efficiency at a sufficiently high level.

Image quality adjustment is also used in the field of image forming apparatuses for adjusting, through process control or the like, the image quality in accordance with predetermined conditions, for example, the conditions immediately after power-on and the conditions when a total number of copies reaches a predetermined value.

In the image forming apparatuses that have a similar configuration as those in the image forming apparatus disclosed in Japanese Patent Application Laid-open No. 2006-201743, an optical sensor is arranged, as a toner-image detecting unit, in the belt-member moving direction and downstream of both the direct transfer position and the secondary transfer position. The color-image forming device forms Y, M, and C toner patterns and the black-image forming device forms a black toner pattern. The Y, M, C, and B toner patterns are transferred onto the belt member and thus a test pattern that includes the Y, M, C, and B toner patterns is formed on the belt member. The optical sensor then detects the test pattern that is formed on the belt member. The image forming conditions are adjusted for the color-image forming device and for the black-image forming device in accordance with the detected result.

The coefficient of friction of the belt member is set higher than the coefficient of friction of the intermediate transfer belt in order to maintain the transcription efficiency of the intermediate transfer belt at a sufficiently high level.

However, the lubricant is transferred from the photosensitive element for B and the intermediate transfer belt to the belt member. Therefore, the coefficient of friction of the belt member may decrease, due to the lubricant on the outer surface of the belt member, to a value lower than the coefficient of friction of the intermediate transfer belt. If the coefficient of friction of the intermediate transfer belt is higher than the coefficient of friction of the belt member, the Y, M, and C toner patterns cannot be adequately transferred onto the belt member and the density of the toner patterns formed on the belt member decreases significantly relative to the density of the toner patterns before the transfer. This prevents correct image quality adjustment and leads to unstable image formation.

SUMMARY OF THE INVENTION

It is an object of the present invention to at least partially solve the problems in the conventional technology.

According to an aspect of the present invention, there is provided an image forming apparatus that includes a first image forming device that includes a first image carrier; a first image forming unit that forms a first toner image on the first image carrier; an intermediate transfer member onto which the first toner image is transferred from the first image carrier during primary transfer; a primary transfer unit that transfers the first toner image from the first image carrier onto the intermediate transfer member; and a secondary transfer unit that transfers the first toner image from the intermediate transfer member onto a recording medium during secondary transfer; a second image forming device that includes a second image carrier; a second image forming unit that forms a second toner image on the second image carrier; and a direct transfer unit that transfers the second toner image from the second image carrier directly onto the recording medium, wherein the second image forming unit is arranged upstream or downstream in a recording-medium moving direction of a secondary transfer position at which the first toner image is transferred during the secondary transfer from the intermediate transfer member onto the recording medium; and a belt member that carries the recording medium thereon to both the secondary transfer position and a direct transfer position at which the second toner image is transferred from the second image carrier onto the recording medium, the belt member being rotatably supported by a plurality of roller members, the image forming apparatus comprising: a lubricant applying unit that applies a lubricant to at least one of the first image forming unit and the second image forming unit; a toner-image detecting unit that faces an outer surface of the belt member and detects any toner image on the belt member; a cleaning member that is in contact with the outer surface of the belt member and removes toner from the outer surface of the belt member; an image adjusting unit that forms a test pattern on the belt member by using the first image forming device and the second image forming device, detects the test pattern by using the toner-image detecting unit, and adjusts, in accordance with a result of the detection, an image forming condition of each image forming unit; and a toner input unit that applies toner to the belt member, thereby inputting toner to a contact section where the cleaning member is in contact with the belt member, wherein after toner is input to the contact section where the cleaning member is in contact with the belt member by the toner input unit, the image adjusting unit forms the test pattern on the belt member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. One skilled in the art can easily make another embodiment by modifying/revising the present invention within the scope of the claims. It is noted that any such modifications/revisions are included in the scope of the claims. The following embodiments are merely examples of the best modes and do not limit the scope of the claims.

First Embodiment

Figure 1:
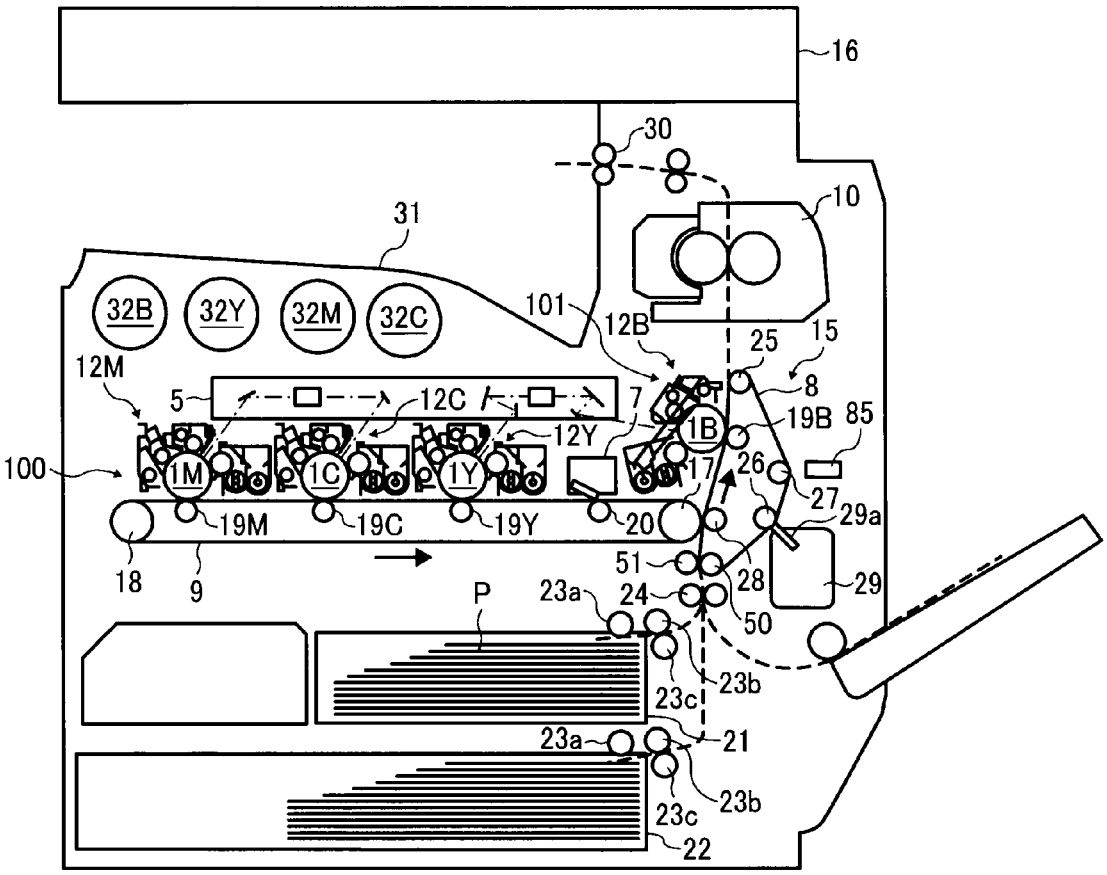
FIG. 1 is a schematic diagram of an image forming apparatus according to a first embodiment of the present invention.

Exemplary embodiments of the present invention are described in detail below with reference to the accompanying drawings. FIG. 1 is a schematic diagram of an image forming apparatus according to a first embodiment of the present invention. As shown in FIG. 1, the image forming apparatus includes a color-image forming device 100 that corresponds to a first image forming device and a black (B)-image forming device 101 that corresponds to a second image forming device.

The color-image forming device 100 includes three image forming units 12Y, 12C, and 12M for yellow (Y), cyan (C), and magenta (M) that correspond to first image forming units; an intermediate transfer belt 9 that corresponds to an intermediate transfer member and extends on a substantially horizontal plane in a loop; three primary transfer rollers 19Y, 19C, and 19M that correspond to primary transfer units; and a secondary transfer roller 28 that corresponds to a secondary transfer unit. The image forming units 12Y, 12C, and 12M are arranged in serial along the intermediate transfer belt 9 in the belt moving direction.

Figure 2:
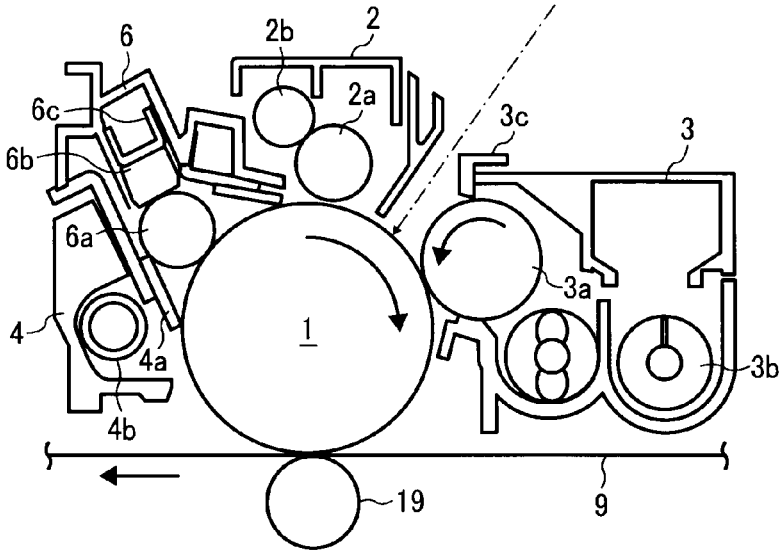
FIG. 2 is a schematic diagram of an image forming unit used in a color-image forming device.

FIG. 2 is a schematic diagram of the image forming unit 12 used in the color-image forming device 100. All the image forming units 12Y, 12C, and 12M have the same configuration; therefore, the letters Y, C, and M that identify the color are deleted from the reference numerals shown in FIG. 2.

As shown in FIG. 2, the image forming unit 12 of the color-image forming device 100 that corresponds to the first image forming device includes a photosensitive element 1 that corresponds to a first image carrier. The photosensitive element 1 is an organic photosensitive element that is produced by forming a photosensitive layer on, for example, a cylindrical aluminum substrate with the diameter about 30 mm to about 90 mm. Moreover, a protective layer is formed on the photosensitive layer with a polycarbonate-based resin. It is allowable to form an intermediate layer between the photosensitive layer and the protective layer. A photosensitive element with the diameter 30 mm is used in the present embodiment. Around the photosensitive element 1 are a charging device 2 that corresponds to a charging unit and evenly charges the surface of the photosensitive element 1; a developing device 3 that corresponds to a developing unit and develops a latent image formed on the photosensitive element 1 with toner; a cleaning device 4 that corresponds to a cleaning unit and removes unnecessary toner, such as residual toner, from the photosensitive element 1, thereby cleaning the photosensitive element 1; and a lubricant applying device 6 that corresponds to a lubricant applying device and applies a lubricant to the surface of the photosensitive element 1.

The charging device 2 includes a charging roller 2*a* that corresponds to a charging member. The charging roller 2*a* includes a conductive cored bar and a middle-level resistant elastic layer that covers the outer surface of the conductive cored bar. The charging roller 2*a* is away a little from the photosensitive element 1 so that the distance between the charging roller 2*a* and the photosensitive element 1 is maintained from 5 μm to 100 μm at their closest sections. This small gap is made by, for example, winding spacer members with a predetermined thickness around non-image forming areas at the both ends of the charging roller 2*a* so that the surfaces of the spacer members are in contact with the surface of the photosensitive element 1. The small gap is preferably from 30 μm to 65 μm. In the present embodiment, the small gap is set to 50 μm. Moreover, the charging roller 2*a* is provided with a charging-roller cleaning member 2*b* that abuts against the surface of the charging roller 2*a* and cleans the charging roller 2*a*. The charging-roller cleaning member 2*b* is, for example, a member that has a surface layer made of melamine resin foam.

The charging roller 2*a* is connected to a power supply (not shown) and charged to a predetermined voltage. Due to electric discharge that occurs within the small gap between the surface of the photosensitive element and the surface of the charging roller, the surface of the photosensitive element is evenly charged. The applied voltage is an alternating voltage that is produced by superimposing an alternating-current (AC) voltage with a direct-current (DC) voltage. When the alternating voltage that is produced by superimposing the AC voltage to the DC voltage is applied to the charging roller 2*a*, because affects are suppressed that are caused by, for example, fluctuations in the charged potential due to small gap fluctuation, the photosensitive element is charged evenly. The applied voltage used in the present embodiment includes a DC voltage −700 v, an AC voltage that has the peak-to-peak voltage of 2 kV, and a square-wave bias that has the frequency of 2 kHz. The charging roller 2*a* has, as a supporting member, a cylindrical conductive cored bar and a resistance adjusting layer that is formed on the outer circumference of the cored bar. The charging roller 2*a* has preferably a hard surface. Although a rubber member is operable as a roller member, because a rubber member is easy to deform, it is difficult to maintain the distance between the charging roller and the photosensitive element 1 even and, under certain image forming conditions, there is a possibility that only the center portion of the charging roller 2*a* protrudes and suddenly comes into contact with the surface of the photosensitive element. It is difficult to cope with distortion of toner caused by partial and sudden contact of the charging roller 2*a* with the surface of the photosensitive element; therefore, it is preferable to use a hard and difficult-to-deform member if noncontact charging is used. Such a hard member for the charging roller 2*a* include, for example, a member that has a resistance adjusting layer made of thermoplastic resin composition containing dispersed polymeric ion-conducting agent (polyethylene, polypropylene, polymethyl methacrylate, polystyrene, copolymer thereof, etc.), the surface of the resistance adjusting layer being coated with a hardening agent using a surface hardening process. The surface hardening process involves, for example, saturating the resistance adjusting layer with a treatment solution that contains isocyanate-containing compound. Alternatively it is allowable to form a surface-harden layer on the surface of the resistance adjusting layer. In the present embodiment, the charging roller 2*a* has the diameter ϕ10 mm.

The developing device 3 includes a developing sleeve 3*a* that faces the photosensitive element 1. The developing sleeve 3*a* has a magnetic-field producing unit inside. Under the developing sleeve 3*a* are two screws 3*b* that convey toner from a toner bottle (not shown) up to the developing sleeve 3*a* so that the toner is mixed and stirred with a developer. With the developer that is made of both toner conveyed up to the developing sleeve 3*a* and magnetic carrier, a developer layer is formed on the developing sleeve 3*a* so that the thickness of the developer layer is adjusted by a doctor blade 3*c*. The developing sleeve 3*a* conveys the developer to the photosensitive element 1, moving in the direction the same as the direction in which the photosensitive element 1 moves, and then applies the toner to the latent-image forming surface of the photosensitive element 1. Although the developing device 3 shown in FIGS. 1 and 2 uses a two-component developer, the developing device 3 can use some other developers such as a monocomponent developer.

The cleaning device 4 includes a cleaning blade 4*a* made of urethane rubber. The cleaning blade 4*a* abuts against the surface of the photosensitive element in such a manner as the leading edge of the cleaning blade 4*a* faces in the opposite direction to the direction of rotation of the photosensitive element 1. The cleaning blade 4*a* holds in place any material attached to the photosensitive element 1, including unnecessary toner, by using the leading edge, thereby cleaning the surface of the photosensitive element 1. As shown in FIG. 2, the cleaning device 4 further includes a collecting coil 4*b* that conveys the toner removed by the cleaning blade 4*a* from the surface of the photosensitive element 1. The unnecessary toner, etc., held in place by the cleaning blade falls to the inside of the cleaning device 4. The toner, etc., is then conveyed by the collecting coil 4*b* toward the front side or the rear side of FIG. 2 and then stored in a used toner tank. In the image forming units used in the color-image forming device, the used toner is not reused to avoid problems caused by toner being mixed with different colors and toner becoming attached to the lubricant. Although, in the present embodiment, a blade-type cleaning device is used as the cleaning device 4, some other devices can be used, such as a fur brush roller or a magnetic-brush cleaning device.

The lubricant applying device 6 includes an applying brush roller 6*a*, a solid lubricant 6*b* that is in contact with the applying brush roller 6*a*, and a pressure applying member 6*c* that presses the solid lubricant 6*b* against the brush roller 6*a*. The applying brush roller 6*a* is in contact with both the photosensitive element 1 and the solid lubricant 6*b*. The rotating brush roller 6*a* scratches off some of the solid lubricant 6*b* and then applies it to the photosensitive element 1. The solid lubricant 6*b* is rectangular and pressed by the pressure applying member 6*c* against the brush roller 6*a*. In the present embodiment, because of the layout limitation, the pressure applying member 6*c* presses the solid lubricant due to the force of gravity by a weight. However, it is allowable to use a spring, such as a flat spring and a compression spring, instead. Although the solid lubricant 6*b* is a consumable and the thickness of the solid lubricant 6*b* decreases with the elapse of time as the brash roller 6*a* scratches it off, because the solid lubricant 6*b* is always pressed by the pressure applying member 6*c*, the solid lubricant 6*b* is always in contact with the brush roller 6*a*.

The brush of the brush roller 6*a* can be carbon-containing acrylic fibers, conductive polyester fibers, etc. The linear mass density of the brush fibers of the brush roller 6*a* are preferably from 3 deniers to 8 deniers. The density of the brush fibers is preferably from 20 thousands to 100 thousands/inch$^2$. If the linear mass density of the brush fibers is too low, when the brush roller 6*a* abuts against the surface of the photosensitive element 1, the brush fibers are likely to bend. On the other hand, if the linear mass density of the brush fibers is too high, the density of the fibers cannot be high sufficiently. Moreover, if the density of the brush fibers is too low, because the number of the brush fibers that abut against the surface of the photosensitive element 1 is too small, the lubricant cannot be applied evenly. If the density of the brush fibers is too high, because the intervals between the fibers are too small, the brash fibers cannot hold a sufficient amount of powders of the lubricant and the sufficient amount of the lubricant cannot be applied. The brush roller 6*a* has the linear mass density and the density within the setting ranges so that the brush fibers are difficult to bend and the lubricant is applied evenly in an efficient manner.

The solid lubricant 6*b* can be a dried, solid, and hydrophobic lubricant. As the hydrophobic lubricant, typically, a zinc stearate lubricant is used. Some materials other than zinc stearate that contain a stearic acid group can be used, for example, barium stearate, lead stearate, ferric stearate, nickel stearate, cobalt stearate, copper stearate, strontium stearate, calcium stearate, cadmium stearate, and magnesium stearate. Moreover, some materials including same fatty acid group can be used, for example, zinc oleate, manganese oleate, iron oleate, cobalt oleate, lead oleate, magnesium oleate, copper oleate, zinc palmitate, cobalt palmitate, copper palmitate, magnesium palmitate, aluminum palmitate, and calcium palmitate. Some other materials that contain fatty acid can also be used, for example, metallic salts of fatty acid such as lead caprylate, lead caproate, zinc linolenate, cobalt linolenate, calcium linolenate, and cadmium lycolinolenate. Moreover, various waxes or the similar can be used, for example, candelilla wax, carnauba wax, rice wax, Japan wax, jojoba oil, bees wax, and lanolin.

The image forming unit 12 is a process cartridge detachable from the main body of the image forming apparatus.

The intermediate transfer belt 9 is supported by a driving roller 17 and a driven roller 18. Inside the intermediate transfer belt 9 are the primary transfer rollers 19Y, 19C, and 19M and a cleaning-device facing roller 20. The primary transfer rollers 19Y, 19C, and 19M correspond to the primary transfer units, each facing the corresponding photosensitive element 1. The primary transfer rollers 19Y, 19C, and 19M are arranged to face the photosensitive elements 1Y, 1C, and 1M provided to the image forming units 12Y, 12C, and 12M across the intermediate transfer belt 9 a little downstream in the rotating direction of the intermediate transfer belt. An intermediate-transfer-belt cleaning unit 7 is arranged outside the intermediate transfer belt 9, facing the cleaning-device facing roller 20. The intermediate-transfer-belt cleaning unit 7 removes residual toner from the intermediate transfer belt 9.

The intermediate transfer belt 9 is made of heat-resisting material such as polyimide or polyamide. The intermediate transfer belt 9 is an endless belt that has a middle-level resistant substrate and the thickness 60 μm.

The secondary transfer roller 28 or the secondary transfer unit faces the driving roller 17 of the intermediate transfer belt 9. The intermediate transfer belt 9 and the secondary transfer roller 28 together make a secondary transfer nip via a sheet conveying belt 8 that corresponds to a belt member.

A sheet conveying device 15 is at the right of the intermediate transfer belt 9 within the space extending under a fixing device 10. The sheet conveying device 15 corresponds to a sheet conveying unit. The sheet conveying device 15 intersects with and is substantially perpendicular to the intermediate transfer belt 9 that extends on a substantially horizontal plane. The sheet conveying device 15 includes the sheet conveying belt 8 that is rotatably supported by a driving roller 25, a tension roller 27, a cleaning-device facing roller 26, an entrance roller 50, the secondary transfer roller 28, and a direct-transfer roller 19B. An attracting roller 51 is outside of the sheet conveying belt 8, facing the entrance roller 50. The attracting roller 51 is applied to a certain voltage so that the recording sheet is attracted toward the sheet conveying belt 8 due to static electrical force. Outside the sheet conveying belt 8 is a conveying-belt cleaning device 29, facing to the cleaning-device facing roller 26. The conveying-belt cleaning device 29 removes toner and powders of paper from the sheet conveying belt 8. The conveying-belt cleaning device 29 includes a cleaning blade 29*a* made of urethane rubber. The cleaning blade 29*a* abuts against the sheet conveying belt 8 and holds in place any material attached to the sheet conveying belt 8, including toner and powders of paper, by using the leading edge, thereby cleaning the surface of the sheet conveying belt 8.

The black-image forming device 101 includes an image forming unit 12B that corresponds to a second image forming unit and the direct-transfer roller 19B that corresponds to a direct transfer unit.

Figure 3:
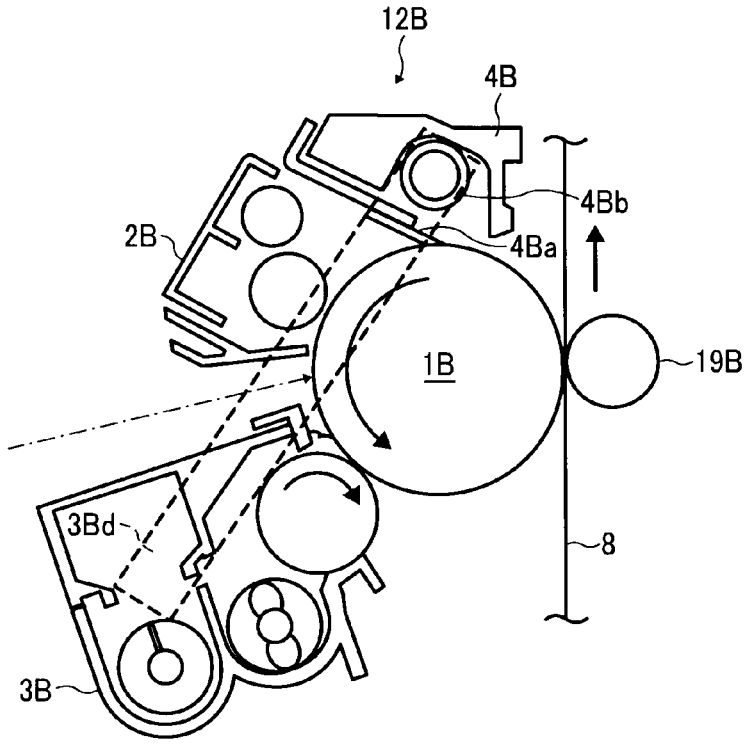
FIG. 3 is a schematic diagram of an image forming unit used in a black-image forming device.

FIG. 3 is a schematic diagram of the image forming unit 12B used in the black-image forming device 101. In the following section, only the differences between the image forming unit 12B and any of the image forming units 12Y, 12C, and 12M used in the color-image forming device 100 will be described.

As shown in FIG. 3, although each of the image forming units 12Y, 12C, and 12M used in the color-image forming device 100 includes the lubricant applying device 6, the image forming unit 12B includes no lubricant applying device. Moreover, the image forming unit 12B for B includes a used-toner conveying path 3Bd that connects a cleaning device 4B and a developing device 3B. Toner removed from the surface of a photosensitive element 1B by using a cleaning blade 4Ba is conveyed by a collecting coil 4Bb toward the front side or the rear side of FIG. 3 to the developing device 3B through the used-toner conveying path 3Bd. With this configuration, the residual toner removed from the surface of the photosensitive element 1B is reused for image formation. It is allowable to arrange a conveying coil or the like within the used-toner conveying path 3Bd.

The image forming unit 12B for B is arranged downstream of the secondary transfer nip in the recording-sheet moving direction, independently from the image forming units for Y, M, and C, so that a black toner image is directly transferred from the image forming unit 12B onto the recording sheet. More particularly, the image forming unit 12B for B is arranged near and along a recording-sheet conveying path that extends in the substantially vertical direction. The direct-transfer roller 19B faces the photosensitive element 1B across the sheet conveying belt 8. The photosensitive element 1B and the direct-transfer roller 19B together make the direct transfer nip via the sheet conveying belt 8.

Above the color-image forming device 100 is an exposing device 5 that irradiates the charged surfaces of the photosensitive elements 1Y, 1C, 1M, and 1B with laser beams, thereby forming a latent image on each surface. The exposing device 5 can use, for example, an LED instead of the laser beams.

The image forming apparatus used in the present embodiment has a full-color mode that corresponds to a first image forming mode and a monochrome mode that corresponds to a second image forming mode. When the full-color mode is selected, a full-color image that is made up of Y, C, M, and B toner images is formed on a recording sheet. In the monochrome mode, a monochrome image that is made up of only a black toner image is formed on a recording sheet. A control unit (not shown) of the image forming apparatus switches between these modes in accordance with image data.

The full-color mode is described below in which a full-color image that is made up of Y, C, M, and B toner images is formed on a recording sheet.

When data containing a color image is received from a scanner 16, a facsimile machine, or a computer, the data is separated into pieces of color-based data and the created color-based data is sent to the exposing device 5. The imaging areas of the evenly charged photosensitive elements 1Y, 1C, 1M, and 1B are irradiated with light coming from the exposing device 5 and toner images are formed by the developing devices 3Y, 3C, 3M, and 3B.

The primary transfer rollers 19Y, 19C, and 19M are applied to a high voltage having the polarity opposite to the polarity of the toner charged voltage. Due to the electric field produced by this voltage, the toner images are sequentially transferred from the photosensitive elements 1Y, 1C, and 1M onto the intermediate transfer belt 9 in a superimposed manner. Thus, a color image made of the Y, M, and C toner images is formed on the intermediate transfer belt 9.

Paper feed trays 21 and 22 accommodate therein recording sheets, i.e., recording media onto which an output image is to be formed. A recording sheet is feed from the paper feed tray 21 or 22 by a retrieving roller 23 and, if two or more recording sheets are fed, separated one from another by a paper feeding roller 23*b* and a separating roller 23*c*. After that, the recording sheet is conveyed to a pair of registration rollers 24. The recording sheet abuts against the registration rollers 24 that are arranged in a sheet conveying path extending in the vertical direction and a skew is corrected. After that, the skew-corrected recording sheet is held between the registration rollers 24. The recording sheet is then conveyed upward by the registration rollers 24 at predetermined operational timing. After the recording sheet is conveyed upward by the registration rollers 24, the recording sheet is further conveyed upward by operation of the entrance roller 50, the sheet conveying belt 8, and the attracting nip, closely attached to the sheet conveying belt 8 by operation of the entrance roller 50. The sheet conveying belt 8 is charged by operation of the attracting roller 51. The recording sheet is closely attached to the sheet conveying belt 8 by operation of the entrance roller 50 and, at the same time, attracted toward the sheet conveying belt 8 due to a static electrical force. The recording sheet that is attracted toward the sheet conveying belt 8 due to the static electrical force is then conveyed to the secondary transfer nip.

The color image is transferred from the intermediate transfer belt 9, at the secondary transfer nip between the secondary transfer roller 28 and the driving roller 17 facing the secondary transfer roller 28 via the intermediate transfer belt 9 due to the voltage applied to between the secondary transfer roller 28 and the driving roller 17 facing the secondary transfer roller 28, onto the recording sheet that is conveyed to the secondary transfer nip by the sheet conveying belt 8. During the secondary transfer, it is allowable to apply a high voltage to the secondary transfer roller 28 in the polarity opposite to the polarity of the toner charged voltage. Moreover, it is allowable to apply a voltage to the driving roller 17 facing the secondary transfer roller 28 in the polarity the same as the polarity of the toner charged voltage.

If the secondary transfer roller 28 is applied to a high voltage in the polarity opposite to the polarity of the toner charged voltage, it is possible to use a high-voltage power supply that is used to apply a voltage to the direct-transfer roller 19B; therefore, an additional power supply is not needed for applying a voltage to the secondary transfer roller 28, which reduces manufacturing costs and the size of the image forming apparatus. In contrast, if the driving roller 17 facing the secondary transfer roller 28 is applied to a voltage in the polarity the same as the polarity of the toner charged voltage, because the voltage is applied to the toner via the intermediate transfer belt 9, even if the recording sheet contains moisture and has a low resistance, adequate transfer will be performed.

The recording sheet with the three-color toner image that is formed at the secondary transfer nip is conveyed to the direct transfer nip by the sheet conveying belt 8. The black toner image is directly transferred at the direct transfer nip from the photosensitive element 1B onto the three-color toner image of the recording sheet.

The recording sheet with the Y, C, M, and B toner images goes away from the sheet conveying belt 8 at a curve of the sheet conveying belt 8, which is downstream of the secondary transfer nip in the sheet-conveying-belt rotating direction, due to the curvature of the driving roller 25 that supports the sheet conveying belt 8 and the hardness of the recording sheet by self stripping and then reaches the fixing device 10. The Y, C, M, and B toner images are fixed to the recording sheet by the fixing device 10 and thus a color image is formed on the recording sheet. After the fixing, the recording sheet is conveyed by a pair of ejecting rollers 30 through a sheet discharging path to a discharge tray 31 and stacked on the discharge tray 31 with the front side down.

The monochrome mode is described below. During monochrome image formation in the monochrome mode, data containing a black image is created in accordance with data received from a scanner, a facsimile machine, or a computer. The imaging area of the photosensitive element 1B is irradiated with light coming from the exposing device 5 and a black toner image is formed by the developing device 3B. The black toner image is directly transferred from the photosensitive element 1B onto a recording sheet that is conveyed by the sheet conveying belt 8. The black toner image is then fixed to the recording sheet by the fixing device 10. Thus, a monochrome image is formed on the recording sheet.

During the monochrome mode, the intermediate transfer belt 9 is completely away from the sheet conveying belt 8 by operation of a later-described moving mechanism (i.e., no secondary transfer nip is made). With this configuration, operations of the image forming units 12Y, 12C, and 12M and the intermediate transfer belt 9 do not affect monochrome image formation. If the image forming units 12Y, 12C, and 12M and the intermediate transfer belt 9 are inactivated during the monochrome mode, the image forming units 12Y, 12C, and 12M, the intermediate transfer belt 9, etc., are prevented from deterioration, which increases the life times of the image forming units 12Y, 12C, and 12M and the intermediate transfer belt 9.

In the present embodiment, the black toner image is directly transferred onto the recording sheet. This direct transfer has advantages in that the number of the necessary parts is reduced and the black image is written, by exposure with a laser beam coming from the exposing device 5, in the same direction as the direction in which the Y, C, and M images that are written by using laser beams. Moreover, because the black toner is transferred from the photosensitive element 1B directly onto the recording sheet by the image forming unit for black, the transcription efficiency is increased with respect to the transcription efficiency of a black image that is transferred from the photosensitive element 1B indirectly onto the recording sheet via the intermediate transfer belt in the same manner as the Y, M, and C images are transferred. Therefore, the direct transfer of the black image from the photosensitive element 1B onto the recording sheet can suppress the amount of black toner consumed to form the black image on the photosensitive element 1B by the image forming unit for black as compared with the indirect transfer of the black image from the photosensitive element 1B onto the recording sheet via the intermediate transfer belt.

The image forming apparatus in the present embodiment includes a control unit (not shown) that is measures for control. The control unit includes, for example, a central processing unit (CPU) that is a calculating unit; a nonvolatile random access memory (RAM) that is a data storage unit; and a read only memory (ROM) that is a data storage unit. The control unit is electrically connected to the charging device 2, the exposing device 5, the developing device 3, etc. The control unit controls these devices using control programs stored in the RAM or the ROM.

The control unit (not shown) adjusts image forming conditions for forming images. More particularly, the control unit applies a charging bias to each charging device 2 for different color, individually. The photosensitive elements 1Y, 1C, 1M, and 1B for different colors are charged evenly to a photosensitive-element charging potential for Y, C, M, and B. Moreover, the control unit independently adjusts the powers of the four laser diodes for different colors used in the exposing device 5. The control unit applies a developing bias for Y, C, M, and B to each developing sleeve. Due to the effects of the developing potential, between the latent images of the photosensitive elements 1Y, 1M, 1C, and 1B and the respective developing sleeves, toner is attracted from the surface of each developing sleeve toward the corresponding photosensitive element due to static electrical force and thus the latent image is developed into a toner image.

When the power is on, when an environment is changed, or when a predetermined number of copies are printed out, the control unit (not shown) performs an image adjusting process for adjusting the densities of images of different colors. In other words, the control unit (not shown) operates as an image adjusting unit.

In the present embodiment, an optical sensor unit 85 is arranged downstream in the rotating direction of the sheet conveying belt 8 of the secondary transfer position at which the four-color toner image is formed on the recording sheet, facing the outer surface of the loop of the sheet conveying belt 8. The optical sensor unit 85 includes three optical sensors that correspond to a toner-image detecting unit.

Figure 4:
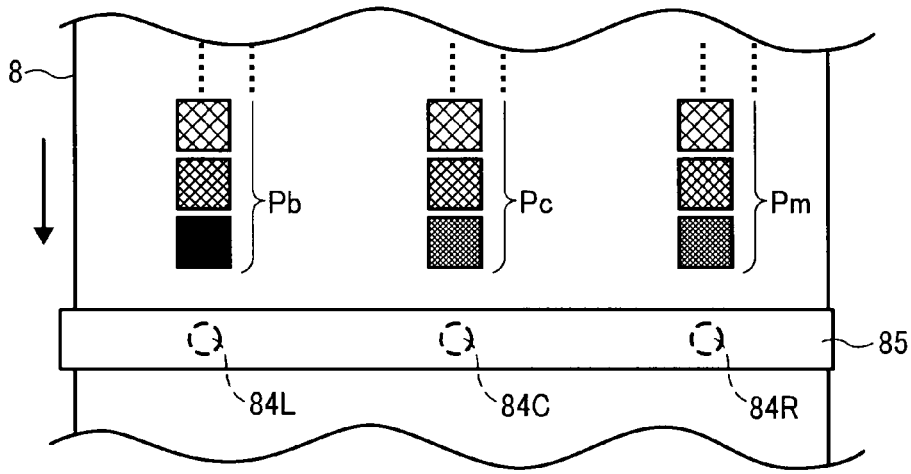
FIG. 4 is a schematic diagram of an optical sensor unit and related components near the optical sensor unit.

FIG. 4 is a schematic diagram of the optical sensor unit 85 and related components near the optical sensor unit 85. As shown in FIG. 4, the optical sensor unit 85 includes a center optical sensor 84C that is arranged at the center of the sheet conveying belt 8 in the belt width direction (the main-scanning direction); a first-end optical sensor 84R that is arranged near a first end of the sheet conveying belt 8 closer to the right side of FIG. 4; and a second-end optical sensor 84L that is arranged near a second end of the sheet conveying belt 8 closer to the left side of FIG. 4. Each of the optical sensors 84R, 84C, and 84L includes a light-emitting element that emits light toward the sheet conveying belt 8 and a light-receiving element that receives light reflected from the sheet conveying belt 8. Each of the optical sensors 84R, 84C, and 84L includes two light-receiving elements and receives two types of light that includes light specularly reflected from the sheet conveying belt 8 and light diffusely reflected.

During the process control, a test pattern is automatically formed on the sheet conveying belt 8. The test pattern includes, as shown in FIG. 4, toner patterns Pb, Pc, Pm, and Py (Py is not shown) for different colors. In the present embodiment, the toner pattern Pb for B is automatically formed on a section of the sheet conveying belt 8 that the second-end optical sensor 84L faces; the toner pattern Pc for C is automatically formed on a section of the sheet conveying belt 8 that the center optical sensor 84C faces; and the toner pattern Pm for M is automatically formed on a section of the sheet conveying belt 8 that the first-end optical sensor 84R faces. The toner pattern Py for Y (not shown) is automatically formed behind any of the toner patterns Pb, Pc, and Pm.

The toner patterns Pb, Pc, Pm, and Py for different colors are charged evenly while the photosensitive elements 1Y, 1M, 1C, and 1B rotate. Although, during the printing process, the photosensitive-element charging potential is fixed, the value of the toner charged potential is increased gradually. By scanning with laser light, a plurality of patch latent images for the toner pattern images are formed on the photosensitive elements 1Y, 1M, 1C, and 1B. The latent images are developed into visual images by the developing devices for Y, M, C, and B. During the developing, the value of the developing bias that is applied to the developing sleeves for Y, M, C, and B is increased gradually. As a result, the Y, M, and C, and B toner pattern images are formed on the photosensitive elements 1Y, 1M, 1C, and 1B.

The toner patterns (Pb, Pm, Pc, and Py) that are formed on the sheet conveying belt 8 pass through, by rotation of the sheet conveying belt 8, the sections that the optical sensors 84L, 84C, and 84R face. Each of the optical sensors 84L, 84C, and 84R receives light that has an amount that depends on the amount of toner attached per unit area of each patch of the toner pattern. When light strikes the B toner, because most of light is absorbed into the surface of the B toner, light reflected from the B toner contain almost no component of diffusely reflected light and the diffusely reflected light is ignorable. Therefore, the amount of black toner attached is detected in the black toner pattern using the voltage output from the light-receiving element that receives specularly reflected light. In contrast, when light strikes any of the Y, M, and C color toners, because light is diffusely reflected from the surface of the toner image, the light-receiving element of the optical sensor 84 that receives specularly reflected light actually receives not only the specularly reflected light but also a lot of the diffusely reflected light. Therefore, the amount of toner attached is detected in each of the Y, M, and C toner patterns using the voltage output from the light-receiving element that receives diffusely reflected light.

After the amount of toner attached is detected in each patch of the toner patterns for the different colors, image forming conditions are adjusted in accordance with each patch of the toner pattern.

Each of the toner patterns (Py, Pm, Pc, and Pb) for Y, M, C, and B includes a plurality of patches. The patches are formed with different combinations of the photosensitive-element charging potential and the developing bias so that the amount of toner attached per unit area (the image density) is increased gradually. The amount of toner attached depends on the developing potential that is the difference between the photosensitive-element charging potential and the developing bias; therefore, the relation between them is expressed as a substantially linear graph on a two-dimensional coordinates.

The control unit calculates, using the detected amount of attached toner of each patch and the developing potential when the corresponding toner patch is formed, a function (y=ax+b) that expresses the linear graph using a regression analysis. The control unit then calculates an appropriate value for the developing bias by substituting a target value of the image density for the function. The control unit calculates, in accordance with the calculated appropriate developing bias, an appropriate value for the charging bias, an appropriate value for the exposure amount, etc. Through such corrections, the image forming conditions are corrected so as to form toner images with the desired image density.

The test pattern formed on the sheet conveying belt 8 can include a positional-deviation detecting pattern. The positional-deviation detecting pattern is detected by each of the optical sensors 84L, 84C, and 84R and the amount of positional deviation of each of the Y, M, C, and B images is calculated. With this configuration, by adjusting the image forming position in accordance with the detected result by each of the optical sensors 84L, 84C, and 84R, alignment between the Y, M, C, and B images is performed.

The test pattern formed on the sheet conveying belt 8 is collected by the conveying-belt cleaning device 29.

The featured points of the present embodiment are described below.

Each of the image forming units 12Y, 12C, and 12M used in the present embodiment includes the lubricant applying device 6 and applies a lubricant to the corresponding photosensitive element 1Y, 1C, or 1M. Some of the lubricant applied to these photosensitive elements is conveyed to the intermediate transfer belt and then conveyed from the intermediate transfer belt 9 to the sheet conveying belt 8. The lubricant is further conveyed from the intermediate transfer belt to both the recording sheet and the sheet conveying belt 8. Residual toner is held in place by the cleaning blade of the intermediate-transfer-belt cleaning unit 7. Due to friction between the held residual toner and the surface of the intermediate transfer belt 9, the lubricant is removed from the intermediate transfer belt. This suppresses a decrease in the coefficient of friction of the intermediate transfer belt 9 due to the lubricant. In contrast, the lubricant attached to the sheet conveying belt 8 is conveyed only to the recording sheet. The conveying belt has almost no chance to be attached with toner other than during the process control. As a result, before the process control, there is a possibility that the lubricant is accumulated on the sheet conveying belt 8. When there is no lubricant attached, the coefficient of friction of the intermediate transfer belt is 0.15 and the coefficient of friction of the sheet conveying belt is 0.20 or higher. Therefore, when no lubricant is attached to the sheet conveying belt, the toner pattern is transferred adequately from the intermediate transfer belt onto the sheet conveying belt. The coefficient of friction of the sheet conveying belt is higher than the coefficient of friction of the photosensitive element for B; therefore, the toner pattern is transferred adequately from the photosensitive element for B onto the sheet conveying belt. However, as described above, if the lubricant is accumulated on the sheet conveying belt, during the process control, the coefficient of friction of the sheet conveying belt decreases significantly due to the lubricant and may decrease to a value lower than the coefficient of friction of the intermediate transfer belt and the coefficient of friction of the photosensitive element for B. As a result, both the transcription efficiency from the intermediate transfer belt to the sheet conveying belt and the transcription efficiency from the photosensitive element for B to the sheet conveying belt decrease significantly, which decreases the density of the tone pattern when the toner pattern is transferred to the belt member with respective to the density of the toner pattern before the transfer. Eventually, the developing performance of each image forming unit is calculated inaccurately using a result of detection by the optical sensors and the image forming conditions are adjusted inappropriately.

To solve the above problems, in the present embodiment, before the process control, an abrasive pattern is formed on the sheet conveying belt 8. The sheet conveying belt is then applied with toner and the abrasive pattern is input to the conveying-belt cleaning device 29. As the abrasive pattern is input to the conveying-belt cleaning device 29, toner of the abrasive pattern is held in place by the cleaning blade 29*a*. Due to friction between the toner and the sheet conveying belt, the surface of the sheet conveying belt is polished. The lubricant is removed from the sheet conveying belt and the coefficient of friction of the sheet conveying belt increases to a value higher than the coefficient of friction of the intermediate transfer belt and the coefficient of friction of the photosensitive element for B. The toner patterns are formed by the image forming devices 100 and 101 at operational timing so that, after the abrasive pattern is input to the cleaning blade 29*a* and then the sheet conveying belt makes at least one revolution, the toner patterns for the different colors are transferred onto the sheet conveying belt. With this configuration, after the lubricant is removed from the sheet conveying belt, the toner patterns are transferred onto the sheet conveying belt. Therefore, the Y, C, and M toner patterns are transferred adequately from the intermediate transfer belt onto the sheet conveying belt and the black toner pattern is also transferred adequately from the photosensitive element for B onto the sheet conveying belt. The density of the toner patterns formed on the sheet conveying belt keeps almost the same level as the density of the toner patterns before the transfer. Therefore, the developing performance of each image forming unit is calculated accurately using the detected result by the optical sensors and the image forming conditions are adjusted appropriately.

Suppose there is a case where, although the number of copies reaches a predetermined value during a continuous image formation, the process control is performed at the end of the continuous image formation. In such a case, it is allowable to form the abrasive pattern during an interval between sheets.

Figure 5:
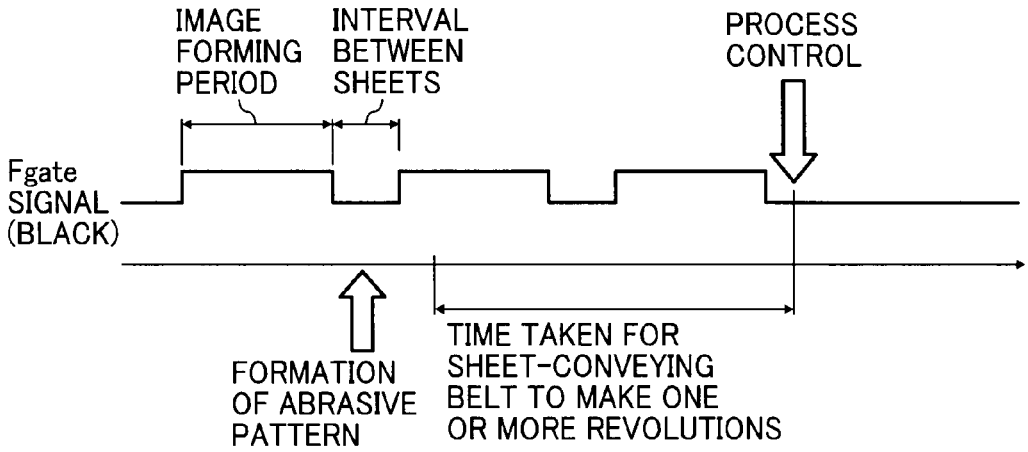
FIG. 5 is a timing diagram of the formation of abrasive patterns.

FIG. 5 is a timing diagram of the formation of the abrasive pattern.

As shown in FIG. 5, the abrasive pattern is formed during an interval between sheets and a time taken for the sheet conveying belt 8 to make one revolution or longer before the process control.

Figure 6:
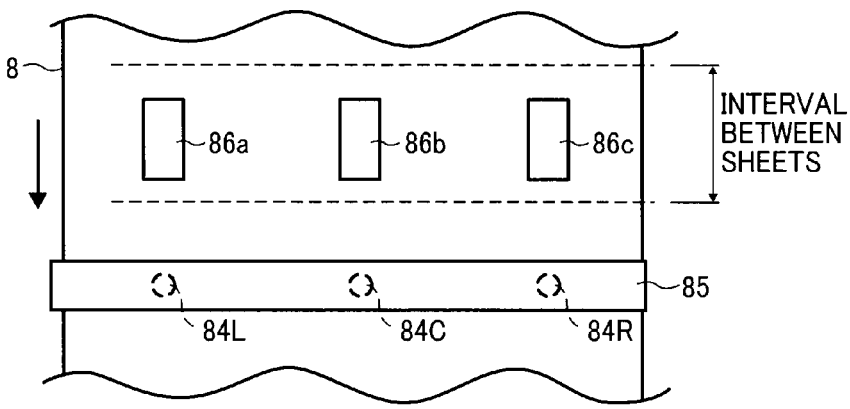
FIG. 6 is a schematic diagram of an example of the abrasive patterns.

FIG. 6 is a schematic diagram of the abrasive pattern formed on the sheet conveying belt.

In the present embodiment, the abrasive pattern formed on the sheet conveying belt 8 by using the black-image forming device 101. The black-image forming device works as a toner input unit. Because the direct transfer position is downstream of the secondary transfer position in the recording-sheet moving direction, if the color-image forming device 100 is used as a toner input unit, the abrasive pattern passes through the direct transfer position. When the abrasive pattern passes through the direct transfer position, there is a possibility that a part of the color toners of the abrasive pattern is attached to the photosensitive element for B. Because the black-image forming device uses, for image formation, used toner collected by a cleaning belt, if the color toner is attached to the photosensitive element for B, the color toner is conveyed to the developing device for black and black toner stored in the developing device for black is mixed with toner of a different color. To avoid such a situation, the abrasive pattern is formed by the black-image forming device. Of course, it is allowable to form the abrasive pattern by the color-image forming device. If the color-image forming device is used to form an abrasive pattern, because the formed abrasive pattern is made up of Y, M, and C toner images in a superimposed manner, as compared with the amount of toner of the abrasive pattern formed by the black-image forming device, the amount of toner of the abrasive pattern will be increased. This increases freedom degree of controlling the amount of toner of the abrasive pattern. The abrasive pattern formed on the sheet conveying belt 8 includes a first abrasive pattern 86*a* that the second-end optical sensor 84L of the optical sensor unit 85 faces; a second abrasive pattern 86*b* that the center optical sensor 84C of the optical sensor unit 85 faces; and a third abrasive pattern 86*c* that the first-end optical sensor 84R of the optical sensor unit 85 faces. Each of the abrasive patterns 86*a* to 86*c* is formed under certain image forming conditions so that the amount of toner attached is 0.6 mg/cm$^2$ or more.

FIG. 6 is a schematic diagram of the abrasive pattern that is formed within an interval between sheets during a continuous image formation. If the abrasive pattern is to be formed during an interval between sheets, the length of the abrasive pattern in the sheet-conveying-belt moving direction is set to 20 mm. If the abrasive pattern is to be formed other than during an interval between sheets, the length of each abrasive pattern can be set larger than 20 mm.

Suppose there is a case where, in the full-color mode, many copies are printed out continuously using small sheets that have a width in the main-scanning direction smaller than the distance between the optical sensors 84L and 84R that are arranged at the opposite ends. Because no sheets are on the end sections of the sheet conveying belt that the optical sensors 84L and 84R face, a larger amount of the lubricant is conveyed from the intermediate transfer belt and, eventually, the coefficient of friction of the end sections becomes lower than the coefficient of friction of the center section that the center optical sensor 84C faces. Therefore, even after the lubricant is removed from the sheet conveying belt as preparation for the process control, there is a possibility that some of the lubricant still remains on the end sections that the optical sensors 84L and 84R face and the coefficient of friction of the end sections is not increased to a sufficiently high level. Therefore, when many copies are printed out continuously using small sheets that have a width in the main-scanning direction smaller than the distance between the optical sensors 84L and 84R that are arranged at the opposite ends, it is preferable to form several abrasive patches at predetermined intervals on the end sections of the sheet conveying belt that the optical sensors 84L and 84R face.

Figure 7:
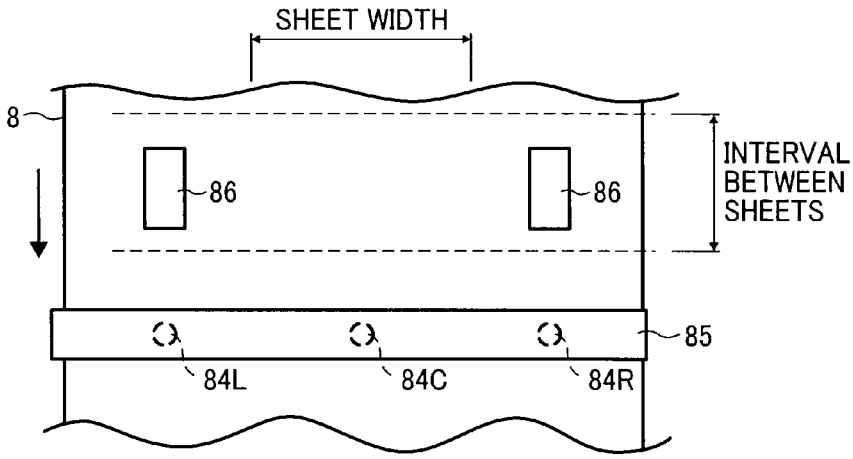
FIG. 7 is a schematic diagram that illustrates positions at which the abrasive patterns are formed when a small-size sheet is used.
Figure 8:
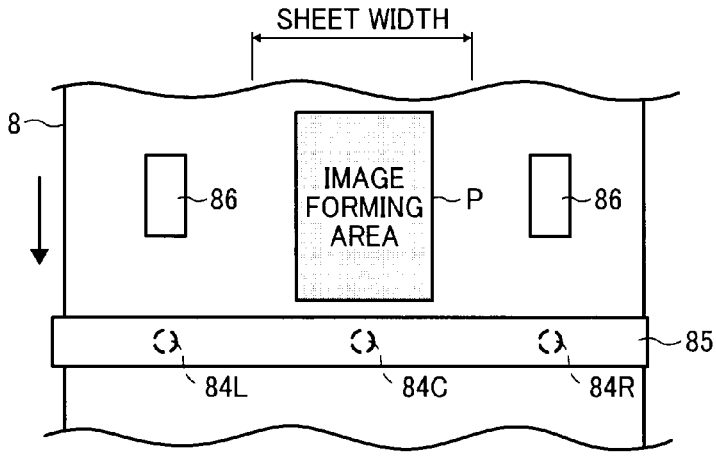
FIG. 8 is a schematic diagram that illustrates positions at which the abrasive patterns are formed when a small-size sheet is used, these positions being different from the positions shown in FIG. 7.

In this situation, the abrasive pattern can be formed within either an interval between sheets as shown in FIG. 7 or areas outside of the both sides of a recording sheet P as shown in FIG. 8. In the present embodiment, if ten or more copies are printed out continuously using small-size sheets, the abrasive pattern is formed on the sheet conveying belt in the above manner.

In the above embodiment, the image forming unit for black reuses the used toner removed by the cleaning device; therefore, the image forming unit for black includes no lubricant applying device. However, the image forming unit for black can have the same configuration as the configuration of the image forming units 12Y, 12M, and 12C.

Toner is described in detail below.

The image forming apparatus in the present embodiment uses toner that is produced by making cross-linking reaction and/or elongation reaction, in an aqueous solvent, of a toner solution that contains at least polyester pre-polymer that includes functional group having nitrogen atom, polyester, a colorant, and a parting agent dispersed in an organic solvent.

The volume average particle size of the toner is preferably from 3 μm to 8 μm. If the toner is used that has a small particle size and a sharp particle-size distribution, because intervals between particles of the toner are small, the necessary amount of toner is decreased without reducing the color reproducibility. This decreases a fluctuation in the density of a developed image. This also improves the degree of stability in reproducibility of a fine dot image higher than 600 dpi, which enables stable high-quality image formation for a long period. If the volume average particle size (D4) is smaller than 3 μm, a decrease in the transcription efficiency and a decrease in the blade cleaning performance are likely to occur. If the volume average particle size (D4) is larger than 8 μm, the pile height of the image is too high to suppress character scattering and line scattering. The ratio (D4/D1) of the volume average particle size (D4) to the number average particle size (D1) is preferably from 1.00 to 1.40.

As the ratio (D4/D1) comes closer to 1.00, the sharper the particle size distribution becomes. If a toner is used that has a small particle size and a narrow particle size distribution, the toner-charged-amount distribution becomes evenly and a high-quality image with less scumming is formed. If the electrostatic transfer is used, the transcription efficiency is increased.

The manner of measuring the toner-particle-size distribution is described below.

Coulter counters for measuring toner-particle-size distribution include, for example, Coulter Counter TA-II and Coulter Multisizer II (these produced by Beckman Coulter Inc.). The measuring manner is described in detail below.

First, a surfactant (preferably, alkylbenzene sulfonate) 0.1 ml to 5 ml is added to an electrolytic solution 100 ml to 150 ml as a dispersant. The electrolytic solution is a solution containing first-grade NaCl about 1 wt %, for example, ISOTON-II (produced by Beckman Coulter Inc.). A measurement sample 2 mg to 20 mg is then added. The electrolytic solution that contains the sample in a suspended form is subjected to a dispersion treatment for about one minute to about three minutes by an ultrasonic dispersing device. After that, the coulter counter measures, using a 100-μm aperture, the volume of the toner particles or the toner and the number of the toner particles or the toner and then calculates the toner-volumetric distribution and the number-of-toner-particles distribution. The volume average particle size (D4) and the number average particle size (D1) are calculated using the calculated distributions.

Thirteen channels are used that have the diameter 2.00 μm to less than 2.52 μm; 2.52 μm to less than 3.17 μm; 3.17 to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm. The particles of toner are measured that have the diameter from 2.00 μm to less than 40.30 μm.

A shape coefficient SF-1 of the toner is preferably from 100 to 150, and a shape coefficient SF-2 is preferably from 100 to 150. The shape coefficient SF-1 represents the circularity of the toner and is expressed as the following equation (1). The shape coefficient SF-1 is calculated by dividing the square value of the maximum length MXLNG, which is the maximum length of the toner that is projected onto a two-dimensional plane, by the area AREA and multiplying the product by 100π/4.

$$SF\text{-}1=\{(\mathrm{MXLNG})^2/\mathrm{AREA}\}\times(100\pi/4) \quad \text{Equation (1)}$$

If the value of SF-1 is 100, the toner is a completely sphere body. As the value of SF-1 increases, the degree of deformation increases.

The shape coefficient SF-2 represents the degree of irregularity of the toner and is expressed as the following equation (2). The shape coefficient SF-2 is calculated by dividing the square value of the perimeter PERI, which is the perimeter of the toner that is projected onto a two-dimensional plane, by the area AREA and multiplying the product by 100/4π.

$$SF\text{-}2=\{(\mathrm{PERI})^2/\mathrm{AREA}\}\times(100/4\pi) \quad \text{Equation (2)}$$

If the value of SF-2 is 100, no irregularity is formed on the surface of the toner. As the value of SF-2 increases, the surface of the toner becomes more irregular.

The measurement of the shape coefficients involves, more particularly, taking an image of the toner using a scanning electron microscope (e.g., S-800 produced by Hitachi, Ltd.), analyzing the taken image using an image analyzing apparatus (e.g., LUSEX3 produced by Nireco corporation), and calculating the shape coefficients using the analyzed result.

As the circularity of the toner increases, because the toner is in point-contact with the photosensitive element, the attraction force between the toner and the photosensitive element decreases and the transcription efficiency increases, which enables high-quality image formation. If either the shape coefficient SF-1 or the shape coefficient SF-2 is higher than 150, the transcription efficiency decreases; therefore, they are preferably 150 or lower.

In the image forming apparatus according to the present invention, B, Y, M, and C toners can be provided respectively, for example, as shown in FIG. 1, by detachable type toner cartridges 32B, 32Y, 32M, and 32C.

Second Embodiment

An image forming apparatus according to a second embodiment of the present invention is described below. The image forming apparatus according to the second embodiment has almost the same configuration as the configuration of the image forming apparatus according to the first embodiment. Only the differences between them are described below.

Figure 9:
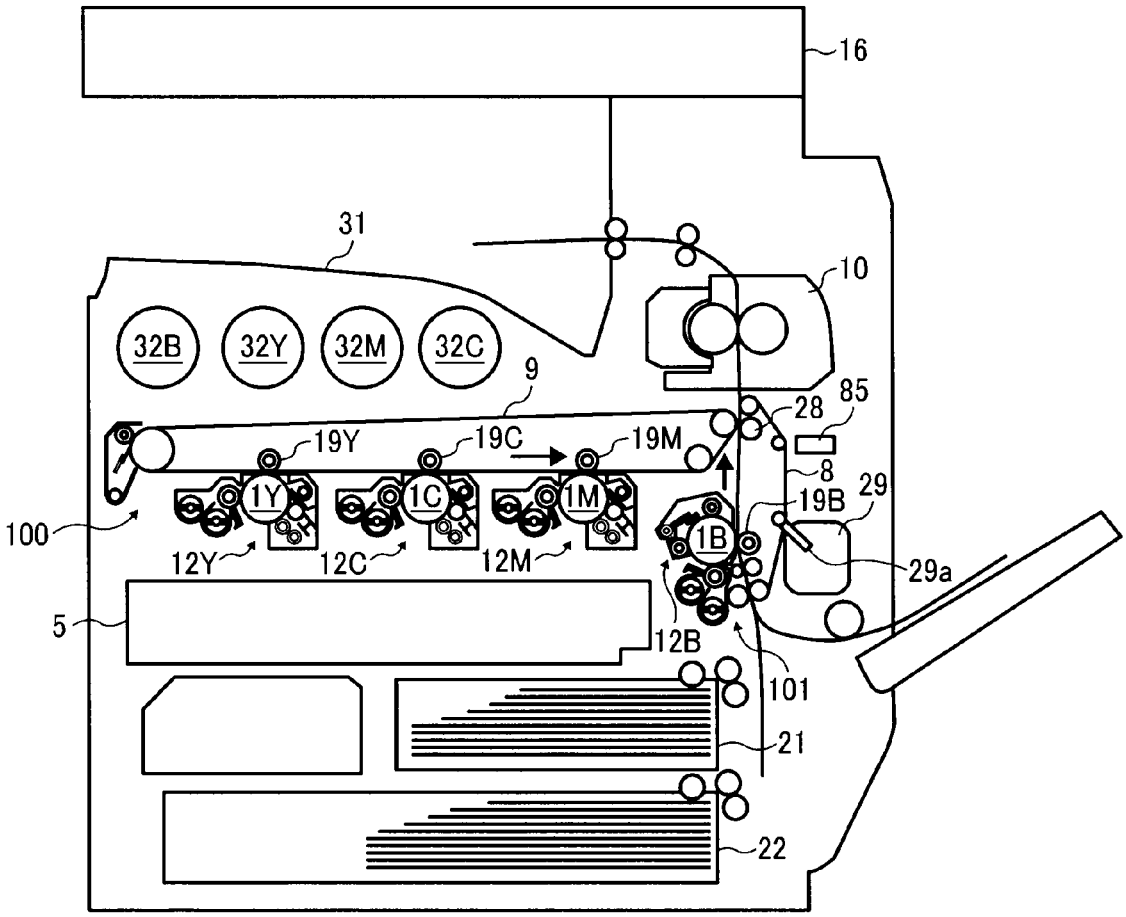
FIG. 9 is a schematic diagram of an image forming apparatus according to a second embodiment of the present invention.

FIG. 9 is a schematic diagram of the image forming apparatus according to the second embodiment.

In the image forming apparatus according to the present embodiment, the black-image forming device is not upstream of the secondary transfer position in the recording-sheet moving direction. The exposing device is under the second image forming device. The intermediate transfer belt is above the image forming units for Y, M, and C.

As described above, because the black-image forming device is upstream of the secondary transfer position in the recording-sheet moving direction, the color toner images of Y, M, and C do not pass through the direct transfer nip. Therefore, the photosensitive element for B is not attached with the color toners of Y, M, and C. The black toner in the developing device for black cannot be mixed with a different-color toner.

As described above, the image forming apparatus according to the present embodiment includes the color-image forming device that corresponds to the first image forming device. The color-image forming device includes the photosensitive elements that correspond to the first image carriers; the image forming units 12Y, 12C, and 12M that correspond to the first image forming units and form the toner images on the photosensitive element; the intermediate transfer belt 9 that corresponds to the intermediate transfer member and onto which the toner images are transferred from the photosensitive elements 1Y, 1C, and 1M during the primary transfer; the primary transfer rollers 19Y, 19C, and 19M that correspond to the primary transfer units and transfer the toner images from the photosensitive elements 1Y, 1C, and 1M onto the intermediate transfer belt 9 during the primary transfer; and the secondary transfer roller 28 that corresponds to the secondary transfer unit and transfers the toner images from the intermediate transfer belt 9 onto the recording sheet or a recording medium during the secondary transfer. The image forming apparatus further includes the black-image forming device 101 that corresponds to the second image forming device and the sheet conveying belt 8 that corresponds to the belt member. The second image forming device 101 is upstream or downstream, in the recording-sheet moving direction, of the secondary transfer position at which the toner images are transferred from the intermediate transfer belt onto the recording sheet during the secondary transfer. The second image forming device 101 includes the photosensitive element 1B that corresponds to the second image carrier; the image forming unit 12B that corresponds to the second image forming unit and forms the toner image on the photosensitive element 1B; and the direct-transfer roller 19B that corresponds to the direct transfer unit and directly transfers the toner image from the photosensitive element 1B onto the recording sheet. The sheet conveying belt 8 is rotatably supported by a plurality of roller members and carries the recording sheet thereon to both the direct transfer position and the secondary transfer position. Moreover, the lubricant applying device that corresponds to the lubricant applying unit is provided to at least one of the image forming units 12Y, 12M, 12C, and 12B. The image forming apparatus further includes the optical sensors that together correspond to the toner-image detecting unit and the cleaning blade 29*a* that corresponds to the cleaning member. The optical sensors being set in the optical sensor unit 85 are arranged facing the outer surface of the sheet conveying belt 8 and detect the density of the toner images formed on the sheet conveying belt. The cleaning blade 29*a* abuts against the outer surface of the sheet conveying belt 8 and removes toner from the outer surface of the sheet conveying belt 8. The control unit that corresponds to the image adjusting unit forms the test patterns on the sheet conveying belt 8 by using the color-image forming device 100 and the black-image forming device 101, detects the test patterns by using the optical sensors, and adjusts, in accordance with the detected result, the image forming conditions for each of the image forming units 12Y, 12C, 12M, and 12B. In the present embodiment, the black-image forming device or the color-image forming device is used as the toner input unit. The toner input device forms the abrasive pattern on the sheet conveying belt, applies the toner to the sheet conveying belt, and inputs the toner to a contact section where the cleaning blade is in contact with the sheet conveying belt. After the abrasive pattern is formed on the sheet conveying belt 8, the toner is applied to the sheet conveying belt, and the toner is input to the contact section where the cleaning blade 29*a* is in contact with the sheet conveying belt 8, the control unit in the present embodiment forms the test patterns on the sheet conveying belt.

As described above, when toner is input to the contact section where the cleaning blade is in contact with the sheet conveying belt, the toner is held in place by the cleaning blade and the outer surface of the sheet conveying belt is scratched by the toner. The outer surface of the sheet conveying belt is polished by the toner held in place by the cleaning blade and the lubricant is removed from the outer surface of the sheet conveying belt. The coefficient of friction of the sheet conveying belt is then increased to a sufficiently high level and thus an adequate test pattern is formed on the sheet conveying belt. As a result, the transcription efficiency after removal of the lubricant attached to the sheet conveying belt is higher than the transcription efficiency before removal of the lubricant and a large decrease is prevented in the density of the test pattern with respect to the density of the test pattern before the transfer. This leads to correct image quality adjustment and stable image formation.

The abrasive pattern is formed on only the sections of the sheet conveying belt that the optical sensors face. Therefore, the sections of the sheet conveying belt that the optical sensors face are polished. Because the test patterns are formed on these sections, if only the coefficient of friction of these sections is increased to a sufficiently high level, the density of the test patterns formed on the sheet conveying belt is not decreased significantly with respect to the density of the test pattern before the transfer. Therefore, as compared with the manner of forming the abrasive pattern in the width direction of the sheet conveying belt, this manner can suppresses the amount of toner consumed and a decrease in the density of the test pattern.

When the total number of copies reaches a predetermined value, the process control is performed. If the total number of copies reaches the predetermined value during a continuous image formation, before the total number of copies reaches the predetermined value, the abrasive pattern is formed on the sheet conveying belt during an interval between sheets so that, when the total number of copies reaches the predetermined value, the coefficient of friction of the sheet conveying belt is at a sufficiently high level. Therefore, when the total number of copies reaches the predetermined number, the text-pattern forming process is performed immediately. This reduces a stand-by time. Moreover, because the abrasive pattern is formed during an interval between sheets, the time that is taken to form the continuous images is not increased.

After the abrasive pattern is input to the contact section where the cleaning blade are in contact with the sheet conveying belt and then the sheet conveying belt makes one or more revolutions, the test pattern is formed on the sheet conveying belt. With this configuration, the test pattern is formed on the section that has an increased coefficient of friction with a certainty.

The several optical sensors are arranged in the main-scanning direction. When an image is formed on a recording sheet that has the width in main-scanning direction shorter than the distance between the optical sensor 84L that is arranged on the one end in the main-scanning direction and the optical sensor 84R that is arranged on the other end in the main-scanning direction (see FIG. 4), the abrasive patterns are formed on the sections of the sheet conveying belt 8 that the optical sensor 84L and the optical sensor 84R face. With this configuration, the amounts of lubricant attached to the sections of the sheet conveying belt that the end-arranged optical sensors face keeps less than the amount of lubricant attached to the section that the center optical sensor faces. Therefore, during polish of the sheet conveying belt before the process control, the coefficients of friction of the sections of the sheet conveying belt that the end-arranged optical sensors face are increased to the level substantially equal to the coefficient of friction of the section that the center optical sensor faces.

The abrasive pattern can be formed on areas of the sheet conveying belt outside of the sides of the recording sheet in the main-scanning direction. In such a case, because any limitation is lifted in the recording-sheet conveying direction, the abrasive pattern can have a length longer than the maximum length of the abrasive pattern formed on an interval between sheets and a necessary amount of toner is input to the contact section where the cleaning blade is in contact with the sheet conveying belt with a certainty.

If the black-image forming device is arranged downstream of the secondary transfer position in the recording-sheet conveying direction, the abrasive pattern is preferably formed by using the black-image forming device. This is because, if the abrasive pattern is formed by using the black-image forming device, the abrasive pattern formed on the sheet conveying belt is input to the cleaning blade without passing through the secondary transfer nip and, therefore, a part of the abrasive pattern cannot be transferred to the intermediate transfer belt. Therefore, a decrease is suppressed in the amount of toner input to the cleaning blade.

If the black-image forming device is arranged upstream of the secondary transfer position in the recording-sheet conveying direction, the abrasive pattern is preferably formed by using the color-image forming device. This is because the abrasive pattern formed on the conveying belt is input to the cleaning blade without passing through the direct transfer nip and, therefore, a part of the abrasive pattern cannot be transferred to the intermediate transfer belt. Therefore, a decrease is suppressed in the amount of toner input to the cleaning blade.

If the color-image forming device is used to form the abrasive pattern, because the abrasive pattern is formed by forming several abrasive patterns by using several image carriers and transferring the abrasive patterns from the image carriers to the intermediate transfer belt in a superimposed manner, the amount of toner attached to the abrasive pattern is increased per unit area. Therefore, even if the length of the detecting pattern in the recording-sheet moving direction is short, a predetermined amount of toner will be input to the cleaning blade.

In the image forming apparatus in which the black-image forming device is arranged upstream of the secondary transfer position in the recording-sheet conveying direction and the lubricant applying devices are provided to only the image forming units 12Y, 12M, and 12C, residual toner removed from the photosensitive element 1B is reused for image formation. This suppresses the amount of black toner consumed. Because no black toner is disposed, the environmental load is reduced. Moreover, because the black-image forming device is arranged upstream of the secondary transfer position, any of the Y, M, and C toner images cannot pass through the direct transfer position. This prevents attaching Y, M, and C toners to the photosensitive element 1B and mixing the black toner with a different color toner. Moreover, because the image forming unit 12B has no lubricant applying device, the black toner is not mixed with a lubricant.

The above lubricant is made of zinc stearate. The zinc stearate has less side effects and a high spreadability over the photosensitive element; therefore, the lubricant is applied evenly with no affects on the image.

According to the present invention, toner is input by a toner input unit to a contact section where a cleaning member is in contact with a belt member and the input toner is held in place by the cleaning member. Due to friction between the toner held in place by the cleaning member and the belt member occurring at the contact section, the surface of the belt member is polished and lubricant is removed from the surface of the belt member. Even when the coefficient of friction of the belt member has been decreased to a low level due to the lubricant attached to the surface of the belt member, the coefficient of friction of the belt member is still increased to a sufficiently high level. After the toner is input by the toner input unit to the contact section, a test pattern is formed on the belt member; therefore, the test pattern is formed on the belt member that has an increased coefficient of friction. As a result, the transcription efficiency with which the test pattern is transferred from the intermediate transfer member to the belt member after removal of a lubricant attached to the belt member is higher than the transcription efficiency with which the test pattern is transferred from the intermediate transfer member to the belt member before removal of the lubricant. Moreover, a large decrease is prevented in the density of the test pattern with respect to the density of the test pattern before the transfer. This leads to correct image quality adjustment and stable image formation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that includes a first image forming device that includes a first image carrier;

a first image forming unit that forms a first toner image on the first image carrier;

an intermediate transfer member onto which the first toner image is transferred from the first image carrier during primary transfer;

a primary transfer unit that transfers the first toner image from the first image carrier onto the intermediate transfer member; and a secondary transfer unit that transfers the first toner image from the intermediate transfer member onto a recording medium during secondary transfer;

a second image forming device that includes a second image carrier;

a second image forming unit that forms a second toner image on the second image carrier; and a direct transfer unit that transfers the second toner image from the second image carrier directly onto the recording medium, wherein the second image forming unit is arranged upstream or downstream in a recording-medium moving direction of a secondary transfer position at which the first toner image is transferred during the secondary transfer from the intermediate transfer member onto the recording medium; and a belt member that carries the recording medium thereon to both the secondary transfer position and a direct transfer position at which the second toner image is transferred from the second image carrier onto the recording medium, the belt member being rotatably supported by a plurality of roller members, the image forming apparatus comprising:

a lubricant applying unit that applies a lubricant to at least one of the first image forming unit and the second image forming unit;

a toner-image detecting unit that faces an outer surface of the belt member and detects any toner image on the belt member;

a cleaning member that is in contact with the outer surface of the belt member and removes toner from the outer surface of the belt member;

an image adjusting unit that forms a test pattern on the belt member by using the first image forming device and the second image forming device, detects the test pattern by using the toner-image detecting unit, and adjusts, in accordance with a result of the detection, an image forming condition of each image forming unit; and a toner input unit that applies toner to the belt member, thereby inputting toner to a contact section where the cleaning member is in contact with the belt member, wherein:

after toner is input to the contact section where the cleaning member is in contact with the belt member by the toner input unit, the image adjusting unit forms the test pattern on the belt member, and after toner is input to the contact section where the cleaning member is in contact with the belt member and then the belt member makes one or more revolutions, the image adjusting unit forms the test pattern on the belt member.

2. The image forming apparatus according to claim 1, wherein the toner input unit applies toner to only a section of the belt member that the toner-image detecting unit faces.

3. The image forming apparatus according to claim 1, wherein when the total number of copies reaches a predetermined value, the image adjusting unit performs adjustment, and if the total number of copies reaches the predetermined value during a continuous image formation, the toner input unit applies toner to the belt member during an interval of sheets and before the total number of copies reaches the predetermined value.

4. The image forming apparatus according to claim 1, wherein the toner-image detecting unit includes a plurality of toner-image detecting units that are arranged in the main-scanning direction, and when images are formed on a plurality of sheets of recording media that have a width in the main-scanning direction shorter than the distance between a first toner-image detecting unit arranged at one end in the main-scanning direction and a second toner-image detecting unit arranged at the other end in the main-scanning direction, the toner input unit applies toner to a first section of the belt member that the first toner-image detecting unit faces and a second section of the belt member that the second toner-image detecting unit faces.

5. The image forming apparatus according to claim 4, wherein the toner input unit applies toner to an area on the belt member outside of a side in the main-scanning direction of the recording medium.

6. The image forming apparatus according to claim 1, wherein the second image forming device is arranged downstream of the secondary transfer position in the recording-medium conveying direction, and the toner input unit is the second image forming device.

7. The image forming apparatus according to claim 1, wherein the lubricant is made of zinc stearate.

8. An image forming apparatus that includes a first image forming device that includes a first image carrier;

a first image forming unit that forms a first toner image on the first image carrier:

an intermediate transfer member onto which the first toner image is transferred from the first image carrier during primary transfer;

a primary transfer unit that transfers the first toner image from the first image carrier onto the intermediate transfer member; and a secondary transfer unit that transfers the first toner image from the intermediate transfer member onto a recording medium during secondary transfer;

a second image forming device that includes a second image carrier;

a second image forming unit that forms a second toner image on the second image carrier; and a direct transfer unit that transfers the second toner image from the second image carrier directly onto the recording medium, wherein the second image forming unit is arranged upstream or downstream in a recording-medium moving direction of a secondary transfer position at which the first toner image is transferred during the secondary transfer from the intermediate transfer member onto the recording medium; and a belt member that carries the recording medium thereon to both the secondary transfer position and a direct transfer position at which the second toner image is transferred from the second image carrier onto the recording medium, the belt member being rotatably supported by a plurality of roller members, the image forming apparatus comprising:

a lubricant applying unit that applies a lubricant to at least one of the first image forming unit and the second image forming unit;

a toner-image detecting unit that faces an outer surface of the belt member and detects any toner image on the belt member;

a cleaning member that is in contact with the outer surface of the belt member and removes toner from the outer surface of the belt member;

an image adjusting unit that forms a test pattern on the belt member by using the first image forming device and the second image forming device, detects the test pattern by using the toner-image detecting unit, and adjusts, in accordance with a result of the detection, an image forming condition of each image forming unit; and a toner input unit that applies toner to the belt member, thereby inputting toner to a contact section where the cleaning member is in contact with the belt member, wherein:

after toner is input to the contact section where the cleaning member is in contact with the belt member by the toner input unit, the image adjusting unit forms the test pattern on the belt member, the second image forming device is arranged upstream of the secondary transfer position in the recording-medium conveying direction, and the toner input unit is the first image forming device.

9. An image forming apparatus that includes a first image forming device that includes a first image carrier; a first image forming unit that forms a first toner image on the first image carrier; an intermediate transfer member onto which the first toner image is transferred from the first image carrier during primary transfer; a primary transfer unit that transfers the first toner image from the first image carrier onto the intermediate transfer member; and a secondary transfer unit that transfers the first toner image from the intermediate transfer member onto a recording medium during secondary transfer; a second image forming device that includes a second image carrier; a second image forming unit that forms a second toner image on the second image carrier; and a direct transfer unit that transfers the second toner image from the second image carrier directly onto the recording medium, wherein the second image forming unit is arranged upstream or downstream in a recording-medium moving direction of a secondary transfer position at which the first toner image is transferred during the secondary transfer from the intermediate transfer member onto the recording medium; and a belt member that carries the recording medium thereon to both the secondary transfer position and a direct transfer position at which the second toner image is transferred from the second image carrier onto the recording medium, the belt member being rotatably supported by a plurality of roller members, the image forming apparatus comprising: a lubricant applying unit that applies a lubricant to at least one of the first image forming unit and the second image forming unit; a toner-image detecting unit that faces an outer surface of the belt member and detects any toner image on the belt member; a cleaning member that is in contact with the outer surface of the belt member and removes toner from the outer surface of the belt member; an image adjusting unit that forms a test pattern on the belt member by using the first image forming device and the second image forming device, detects the test pattern by using the toner-image detecting unit, and adjusts, in accordance with a result of the detection, an image forming condition of each image forming unit; and a toner input unit that applies toner to the belt member, thereby inputting toner to a contact section where the cleaning member is in contact with the belt member, wherein: after toner is input to the contact section where the cleaning member is in contact with the belt member by the toner input unit, the image adjusting unit forms the test pattern on the belt member, the second image forming device is arranged upstream of the secondary transfer position in the recording-medium conveying direction, the lubricant applying unit is provided to only the first image forming unit, and residual toner removed from the second image carrier is reused for image formation.

* * * * *